United States Patent [19]

Nakamura et al.

[11] Patent Number: 4,675,667

[45] Date of Patent: Jun. 23, 1987

[54] METHOD FOR DRIVING LIQUID-CRYSTAL PANEL

[75] Inventors: Takashi Nakamura, Hiratsuka; Katsunori Hatanaka, Yokohama; Satoshi Omata, Tokyo; Yoshiyuki Osada, Yokosuka, all of Japan

[73] Assignee: Canon Kabushiki Kaisha, Tokyo, Japan

[21] Appl. No.: 649,297

[22] Filed: Sep. 11, 1984

[30] Foreign Application Priority Data

Sep. 21, 1983 [JP] Japan ..... 58-174476

[51] Int. Cl.[4] ..... G09G 3/36

[52] U.S. Cl. ..... 340/784; 340/811; 340/812; 340/805

[58] Field of Search ..... 340/718, 719, 783, 784, 340/802, 805, 811, 812

[56] References Cited

U.S. PATENT DOCUMENTS 4,231,035 10/1980 Van Doorn et al. ..... 340/784

4,378,557 3/1983 Murata ..... 340/784

4,560,982 12/1985 Sonehara et al. ..... 340/784

*Primary Examiner*—Gerald L. Brigance

*Attorney, Agent, or Firm*—Fitzpatrick, Cella, Harper & Scinto

[57] ABSTRACT

In a method for driving a liquid-crystal display panel of the type in which each of display picture elements arranged in a matrix array is provided with a switching transistor; a common electrode is formed on a first base plate disposed in opposed relationship with a second base plate with display picture element electrodes thereon, a liquid crystal being sandwiched between the first and second base plates; and the liquid crystal is driven by an alternating electric field of two voltage levels given by switching the potential of the common electrode between two potential levels during each display cycle, the potential of the common electrode is either linearly or non-linearly decreased during a display period at the lower voltage level of the two voltage levels and the potential of the common electrode is also either linearly or non-linearly increased during a display period at the higher voltage level.

12 Claims, 14 Drawing Figures

METHOD FOR DRIVING LIQUID-CRYSTAL PANEL

BACKGROUND OF THE INVENTION

The present invention relates generally to a method for driving a liquid-crystal display panel and more particularly to a method for driving an active matrix type liquid-crystal display panel of the type in which switching transistors are connected to picture elements of the liquid-crystal display panel.

Well known in the art are the matrix type liquid-crystal display panels in which each display unit or element is provided with a switching transistor in order to display a numeral, letter or other kind of image.

Such liquid-crystal display panels as described above have an equivalent circuit as shown in FIG. 1. For instance, each display unit or element comprises one of thin film transistors 4*a*–4*c* made of amorphous silicon and one of liquid-crystal unit cells 5*a*–5*c*. The thin film transistors 4*a*–4*c* are formed over a glass substrate by a thin film formation technique. The gates of the transistors 4*a*–4*c* are connected to scanning electrodes 2*a*–2*c*, respectively, and the sources are connected to a signal electrode 1. The drains are connected to one of the terminal electrodes of the liquid-crystal unit cells 5*a*–5*c*, respectively. The other terminals of the liquid-crystal unit cells 5*a*–5*c* are connected to a common electrode 3 which is disposed in opposed relationship with the glass substrate, the liquid-crystal being sandwiched between the glass substrate and the common electrode 3. Such a liquid-crystal display panel as described above is operated by an AC driving method as will be described below with reference to FIGS. 2–5.

FIG. 2(*a*) shows a voltage waveform applied to the common electrode 3; FIG. 2(*b*), a voltage applied to the signal electrode 1; FIGS. 3(*a*), 4(*a*) and 5(*a*), voltage waveforms applied to the scanning electrodes 2*a*, 2*b*, and 2*c*, respectively; and FIG. 3(*b*), 4(*b*) and 5(*b*), voltages V applied to the liquid-crystal unit cells 5*a*, 5*b* and 5*c*, respectively.

When a voltage $V_G$ is applied to the gate of the thin-film transistor 4, the transistor 4 is turned on so that the voltage between the electrodes sandwiching the liquid-crystal approaches a voltage which is the difference between the potentials of the signal electrode 1 and the common electrode 3. In this case, in order to ensure a high quality image, this voltage must be maintained substantially at a predetermined level even after the voltage applied to the scanning electrode 2 is removed so that the thin-film transistor 4 is turned off. This must be maintained until the subsequent cycle (display cyclic period) when the content of the subsequent display is changed.

With such a display panel as described above, the so-called matrix display can be effected by selecting the transistors through the scanning electrodes 2*a*–2*c*, but it has the following defects.

As is well known in the art, a thin-film transistor has an electrostatic capacitance $C_{GD}$ between the drain and the gate electrodes and a liquid-crystal unit cell can be regarded as a capacitor. Therefore, if the liquid-crystal unit cell is assumed to have a capacitance $C_{LC}$, an equivalent circuit of one picture element or pixel of the liquid-crystal display panel is as shown in FIG. 6 when the thin-film transistor is turned off. At the points of time when the potentials of the common electrode 3 changes ($T_1$–$T_4$ in FIGS. 2–5), the transistor is turned off so that the equivalent circuit as shown in FIG. 6 represents one picture element or pixel of the liquid-crystal display panel. In FIG. 6, when the potential of the common electrode 3 changes by ΔVc, the voltage across the capacitor $C_{LC}$ changes by ΔV which is given by the following equation (1).

$$\Delta V = \frac{C_{GD}}{C_{LC} + C_{GD}} \cdot \Delta Vc \tag{1}$$

The polarity of the voltage ΔV is the same as that of the voltage ΔVc. As a consequence, as shown in FIGS. 3–5, the voltage ΔV always functions to decrease the absolute value of the voltage $V_{LC}$ across the capacitor $C_{LC}$. This means that the effective value of the voltage applied to the liquid-crystal is decreases by the voltage ΔV.

When the decrements in the effective values of the voltages applied to the liquid-crystal unit cells 5*a*, 5*b* and 5*c* are assumed to be $\Delta V_{EFa}$, $\Delta V_{EFb}$ and $\Delta V_{EFc}$, the following relationship is present as is apparent from FIGS. 3–5.

$$\Delta V_{EFa} < \Delta V_{EFb} < \Delta V_{EFc} \tag{2}$$

And we may consider that $$\Delta V_{EFa} \approx 0 \tag{3}$$

and $$\Delta V_{EFC} \approx \Delta V \tag{4}$$

This means that even when the same signal voltage is applied to each of the picture elements of the liquid-crystal display panel, there exists a difference in effective value of applied voltage between the picture elements to which are applied the scanning voltages at different points of time. As a result, there is a difference in light transmissivity between picture elements so that a luminance gradient occurs over the whole picture.

In the liquid-crystal display panels, the scanning voltage is applied sequentially from the leftmost scanning electrode so that, as is apparent from FIGS. 3–5, the closer to the leftside a picture element is, the higher a light transmissivity it has. When the following values are assumed:

$C_{LC}$=1 PF,
$C_{GD}$=0.05 PF and
$\Delta V_C$=10 V, then, from Eq. (1) and Eq. (4), the voltage decrements are calculated as follows:

$$\Delta V = 0.48 \text{ V}$$

and $$\Delta V_{EFc} = 0.48 \text{ V}$$

When the gradational display is effected by changing the voltage applied to the signal electrodes by a step of 0.24 V, for example, the voltage of 0.48 V is equivalent to the voltage representing two steps of gradation. As a result, it is impossible to effect a practical gradational display. FIG. 7 shows the relationship between the location of a picture element on the panel obtained by the simulation under the above-described conditions and the effective value of the voltage applied across the liquid-crystal (the signal voltage is 6.5 V) at the picture element. The ordinate represents the voltage while the abscissa represents the location on the liquid-crystal panel where the leftmost end is represented by 0 and the rightmost end is represented by 1. It is seen that the effective voltage value changes almost linearly relative to the location.

SUMMARY OF THE INVENTION

A primary object of the present invention is therefore to substantially overcome the above-described defects of the conventional methods for driving liquid-crystal display panels and to realize a practical gradational representation by a liquid-crystal display panel.

Another object of the present invention is to provide a liquid-crystal display panel which can give a display of so-called uniform illumination without causing a luminance gradient.

In a liquid-crystal display panel driving method of the type in which each of picture elements arranged in a matrix array is provided with a switching transistor; a common electrode is formed on a base plate which is disposed in opposed relationship with a base plate with display picture elements or pixels so that a liquid-crystal is sandwiched between the two base plates; and the liquid-crystal is driven by alternating electric fields of two voltage levels given by switching the potential of the common electrode between two levels in each display cycle. The above-described objects of the present invention are accomplished by gradually decreasing the potential of the common electrode during a display cycle at the lower voltage level of the two voltage levels and by gradually increasing the potential of the common electrode during a display cycle at the higher voltage level.

DETAILED DESCRIPTION OF PREFERRED EMBODIMENTS

The present invention will be described in detail hereinbelow with reference to the accompanying drawings.

Figure 1:
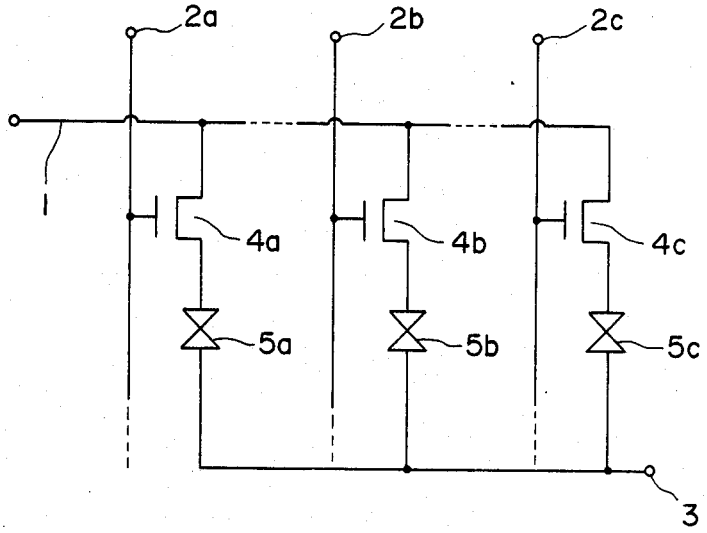
FIG. 1 PRIOR ART
FIG. 1 shows an equivalent circuit of a matrix type liquid-crystal display panel.
Figure 2:
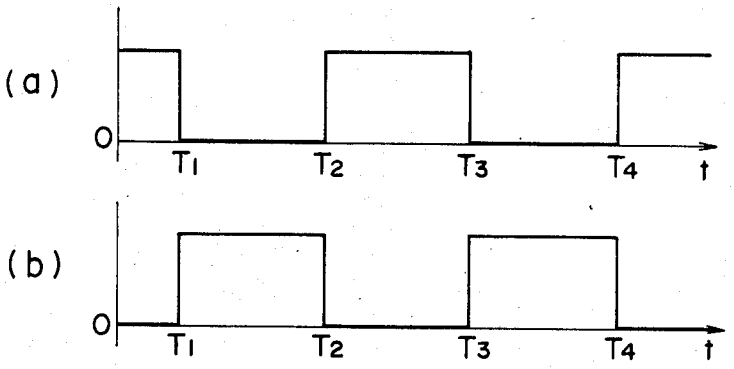
FIG. 2 PRIOR ART
FIGS. 2(*a*) and (*b*) are views used to explain a conventional method for driving a liquid-crystal display panel.
Figure 3:
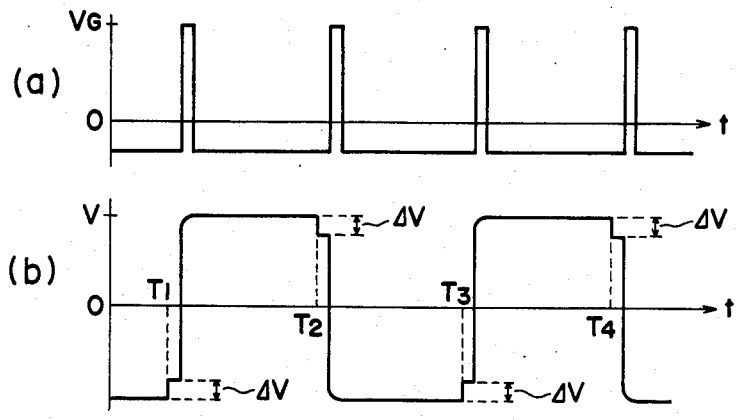
FIG. 3 PRIOR ART
FIGS. 3(*a*) and (*b*), 4(*a*) and (*b*) and 5(*a*) and (*b*) are views used to explain the scanning electrode potential and the voltage applied to a liquid-crystal in the conventional driving method.
Figure 4:
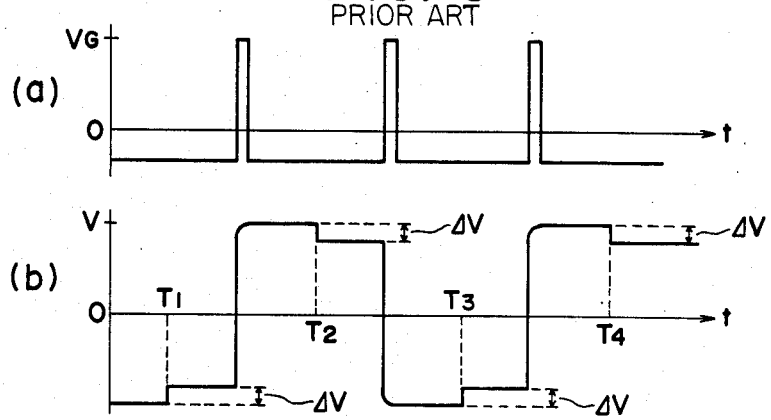
FIG. 4 PRIOR ART
Figure 5:
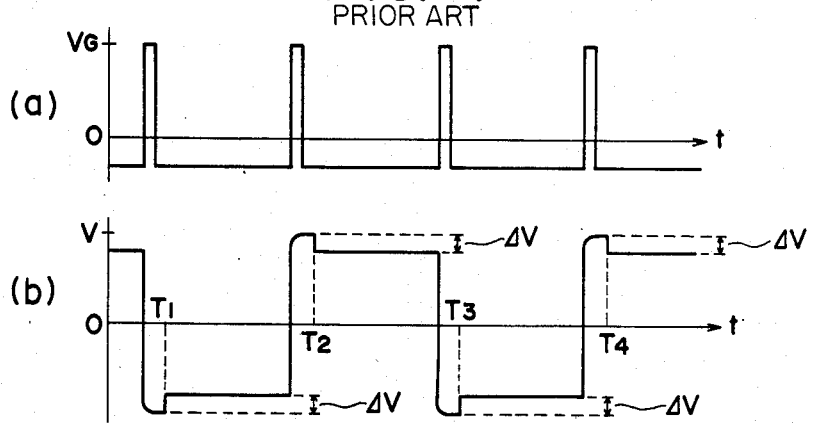
FIG. 5 PRIOR ART
Figure 6:
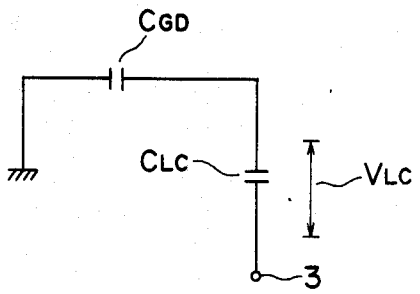
FIG. 6 PRIOR ART
FIG. 6 shows an equivalent circuit of one picture element of a liquid-crystal display panel when a switching transistor is turned off.
Figure 7:
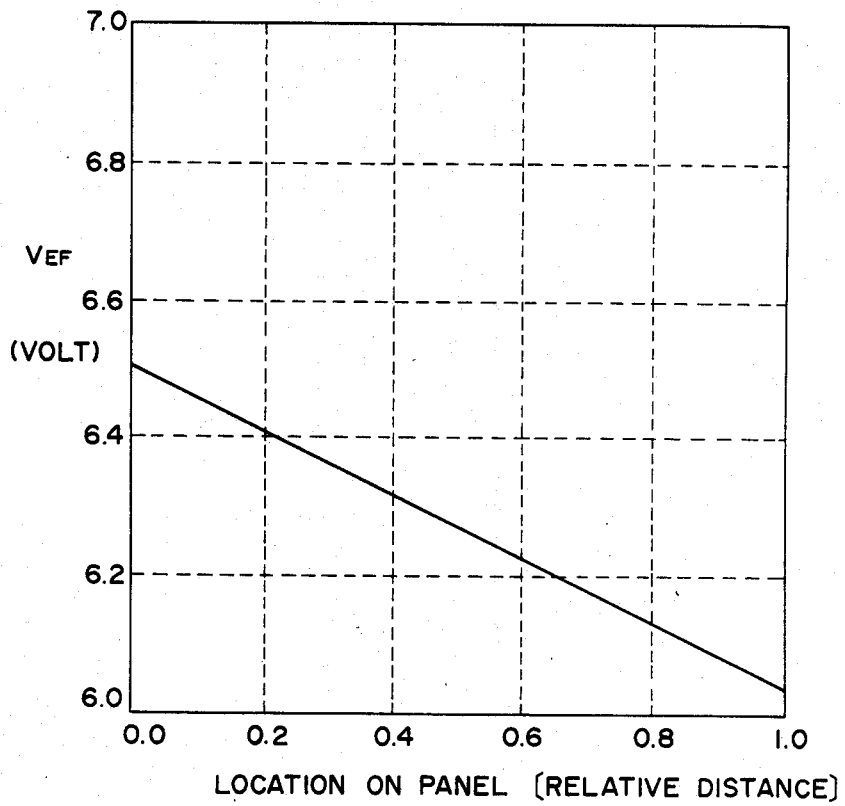
FIG. 7 PRIOR ART
FIG. 7 is a view used to explain the relationship between the location on a liquid-crystal panel and the effective value of the voltage applied to a liquid crystal when the conventional driving method is employed.
Figure 8:
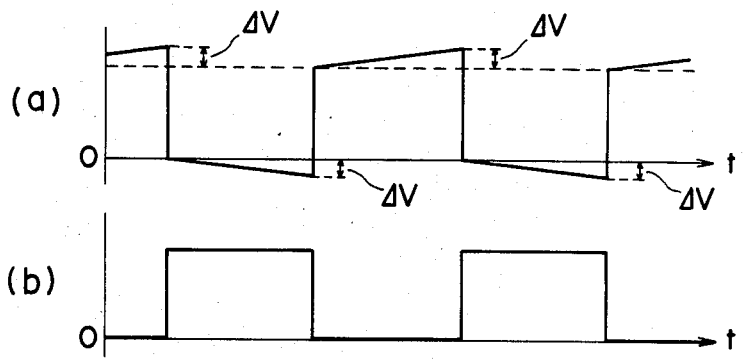
FIGS. 8(*a*) and (*b*) are views used to explain a driving method in accordance with the present invention.
Figure 9:
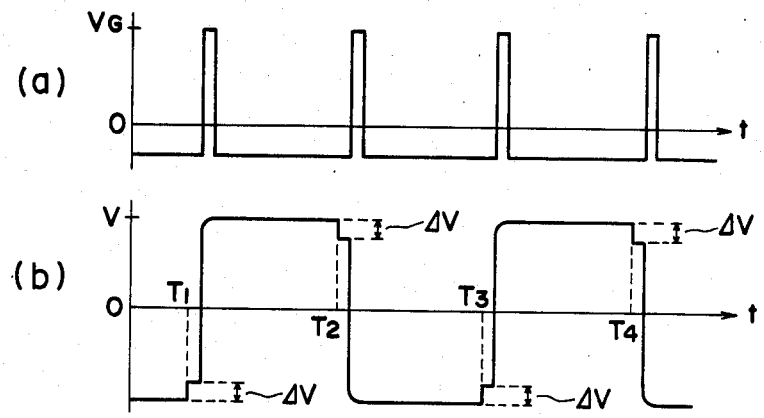
FIGS. 9(*a*) and (*b*), 10(*a*) and (*b*) and 11(*a*) and (*b*) are views used to explain the scanning voltage and the voltage applied to a liquid crystal when the driving method in accordance with the present invention is employed.
Figure 10:
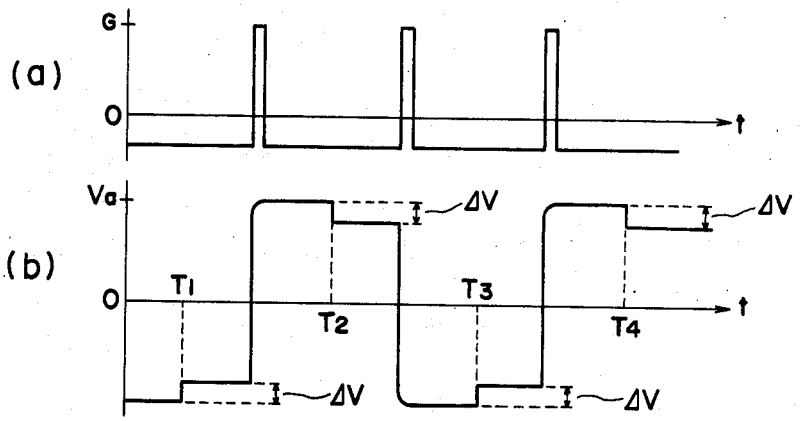
Figure 11:
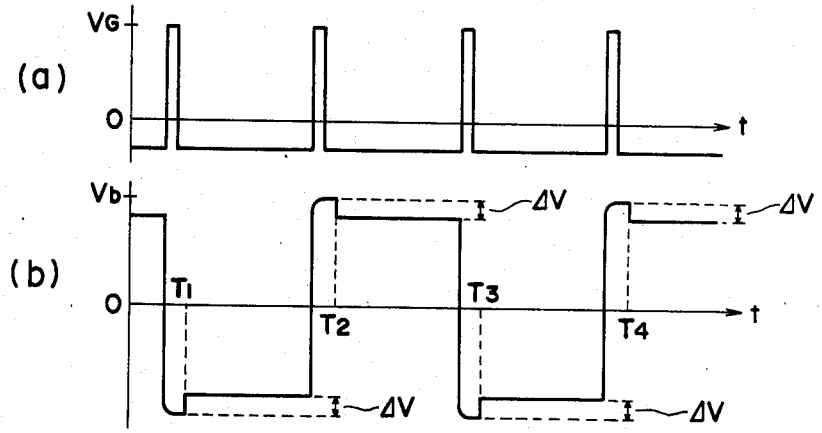

FIGS. 8–11 are views used to explain an embodiment of the present invention. The ordinate represents a voltage while the abscissa represents time. FIG. 8(*a*) shows the potential of the common electrode 3 while FIG. 8(*b*) shows the potential of the signal electrode 1. As described above with reference to FIG. 7, according to the conventional liquid-crystal driving method, the effective value of the voltage applied to a liquid-crystal is substantially linearly decreased with respect to the location or position on a display panel. According to the liquid-crystal display panel driving method in accordance with the present invention, because of the knowledge that when the liquid-crystal charging voltage is linearly increased with respect to the location, the decrease in effective voltage with respect to the location can be cancelled or eliminated, the potential of the common electrode is changed by AV in the form of a ramp during a display cycle as shown in FIG. 8(*a*). FIG. 8(*b*), FIG. 9(*a*), FIG. 10(*a*) and FIG. 11(*a*) are similar to FIG. 2(*b*), FIG. 3(*a*), FIG. 4(*a*) and FIG. 5(*a*), respectively. FIG. 9(*b*), FIG. 10(*b*) and FIG. 11 show the voltages applied across the liquid-crystal unit cells 5*a*, 5*b* and 5*c* of the display panel in accordance with the present invention.

As shown in FIG. 9(*b*), the peak value of the voltage applied across the liquid-crystal unit cell 5*a* is V, but the peak value applied across the liquid-crystal unit cell 5*b* is Va as shown in FIG. 10(*b*). That is, the voltage Va is so selected that the effective voltages applied across the liquid-crystal unit cells 5*a* and 5*b* will be the same ($V<Va$). The peak value of the voltage applied across the liquid-crystal unit cell 5*c* is Vb as shown in FIG. 11(*b*). The voltages V, Va and Vb are so selected that the effective voltages applied across the liquid-crystal unit cells 5*a*, 5*b* and 5*c* will be the same ($V<Va<Vb$).

Figure 12:
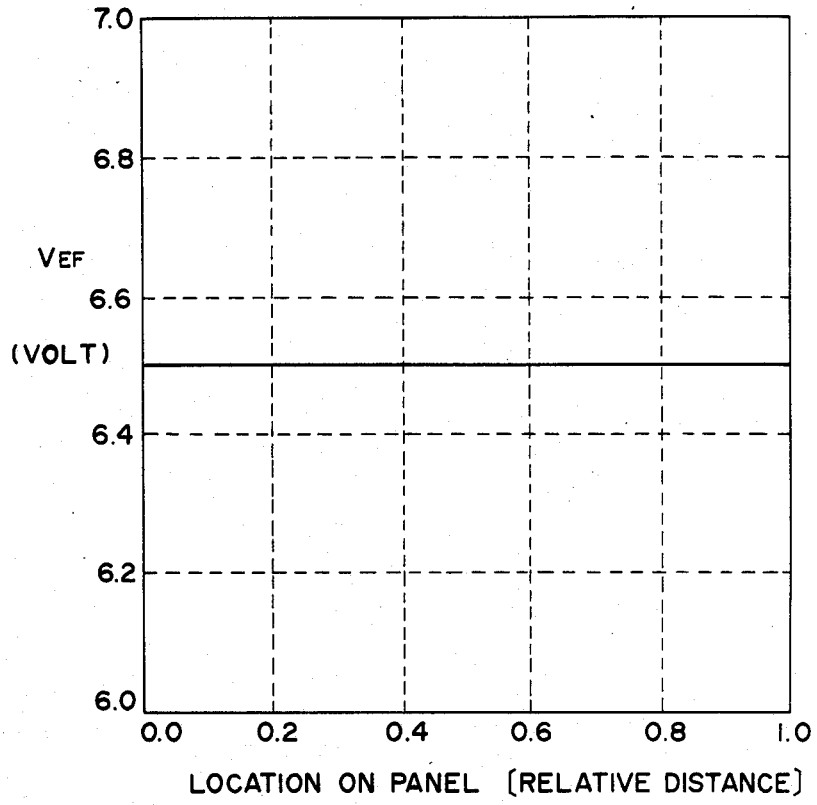
FIG. 12 is a view used to explain the relationship between the location on a liquid-crystal panel and the effective value of the voltage applied to a liquid crystal when the driving method in accordance with the present invention is employed.

FIG. 12 shows the relationship between the location on the panel and the effective value of the voltage applied to the liquid crystal. This data has been obtained by simulation when the signal voltage is 6.5 V. It is seen that according to the present invention, the change in effective voltage applied to liquid crystal is substantially eliminated.

Figure 13:
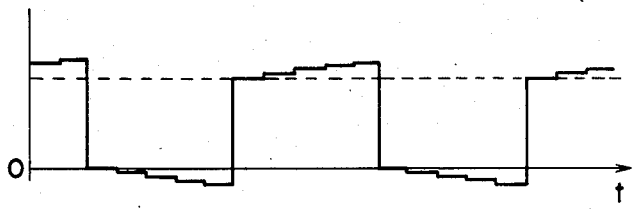
FIG. 13 is a view used to explain another embodiment of the present invention.

So far it has been described that the potential of the common electrode is linearly changed during a display cycle, but it is to be understood that if the satisfactory cancellation effect can be obtained by nonlinearly changing the potential the common electrode, it is not necessary to change linearly the potential of the common electrode. Furthermore, if it is difficult to change the potential continuously, the voltage can be changed stepwise as shown in FIG. 13. In this case, the objects of the present invention can be also accomplished. Moreover the objects of the present invention can be also attained by changing the higher or lower voltage during a display cycle when it is difficult to change both the higher and the lower voltages.

So far the switching transistors used in the present invention have been described as comprising amorphous silicon thin-film transistors, but it is to be understood that the same driving method can be employed even when single-crystal silicon thin film transistors, poly silicon thin film transistors or other amorphous semiconductor thin film transistors are used. The present invention is applicable to all the types of liquid crystals including the field-effect type liquid crystals or the liquid crystals utilizing the dynamic scattering-effect as far as they are used for display in response to the application of a voltage. The method of the present invention is especially adapted for use with twisted nematic type liquid crystal as disclosed by M. Schadt and W. Helfrich in "Applied Physics Letters", Vol.18, No. 4 (Feb. 5, 1971) pp. 127–128, "Voltage-Dependent Optical Activity of a Twisted Nematic Liquid Crystal". In this type of liquid crystals, when no electric field is applied, molecules of a nematic liquid crystal having positive dielectric anisotropy form a structure twisted in the direction of thickness of a liquid crystal layer (helical structure) and the liquid crystal molecules are arranged in parallel with each other at the both electrode surfaces. When an electric field is applied, the molecules of the nematic liquid crystal with positive dielectric anisotropy are arranged in the direction of the electric field so that optical modulation can be effected. When this type of liquid crystal is used to fabricate a matrix type liquid-crystal display panel of the type described above, a voltage higher than the threshold voltage at which the liquid crystal molecules are caused to be arranged perpendicular to the electrode surfaces is applied to the regions (selected points) at which both the scanning and the signal electrodes are selected. On the contrary, no voltage is applied to the regions (non-selected points) at which the scanning and the signal electrodes are not selected, whereby the liquid crystal molecules can maintain the stable arrangement in parallel with the electrode surfaces. When linear polarizers are disposed in the cross nicol relationship above and below such a liquid-crystal cell as described above, no light is transmitted at the selected points while light is transmitted at the non-selected points. Therefore it may be used as a display device.

Figure 14:
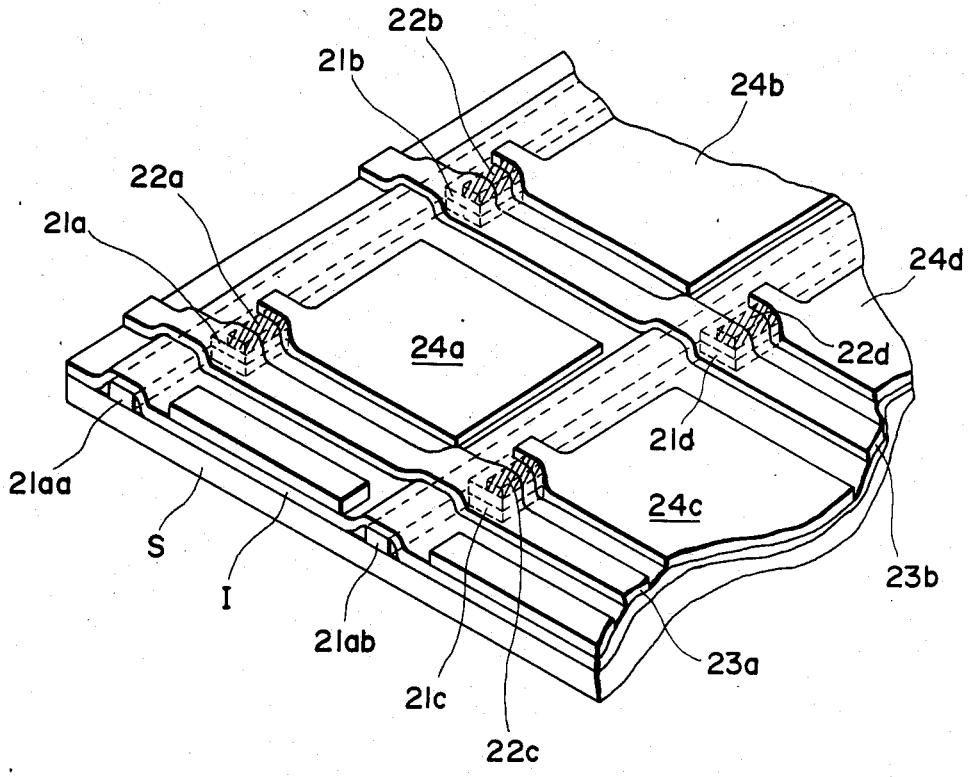
FIG. 14 is a perspective view of thin-film transistors used in the driving method in accordance with the present invention.

Thin film transistors as shown in FIG. 14 can be used in the liquid-crystal display panel driving method in accordance with the present invention.

In FIG. 14, driving thin film transistors (TFT) are arranged in a matrix array at a density of the order of 2–10 lines/mm on a base plate (glass or the like). Thin film transistors (TFT) comprise gate lines 21*aa* and 21*ab* (transparent or metallic thin conductor films formed on the base plate S, gate electrodes 21*a*, 21*b*, 21*c* and 21*d* formed on the gate lines 21*aa* and 21*ab*, an insulating film I laminated on these electrodes, thin film semiconductors 22*a*, 22*b*, 22*c* and 22*d* formed above the gate electrodes through insulating films, source lines (comprising conductor films) 23*a* and 23*b* connected to one end each of the semiconductors, and drain electrodes 24*a*, 24*b*, 24*c* and 24*d* connected to the other ends of the semiconductors.

The drain electrodes are made of a transparent conductor film such as $In_2O_3$, $SnO_2$ or the like or a metallic thin film of Au, Al, Pd or the like. The gate electrodes and the source lines are made of a metal such as Al, Au, Ag, Pt, Pd, Cu or the like.

As described above, according to the present invention, the voltage applied to the common electrode is changed along the progress of time so that variations in effective voltage between picture elements due to the parasitic capacitance $C_{GD}$ between the gate and drain of each thin film transistor can be substantially eliminated. As a result, a high quality display, particularly, a display without gradation can be obtained.

What is claimed is:

1. In a method for driving a liquid-crystal panel of the type in which each of the display picture elements arranged in a matrix array is provided with a switching transistor, and a common electrode is formed on a first base plate disposed in opposed relationship with a second base plate with display picture element electrodes thereon, a liquid crystal being sandwiched between said first and second base plates; the driving method comprising:

switching the potential of said common electrode between two levels at each display cycle thereby to apply an alternating electric field of two voltage levels to the respective picture elements in association with the potential level of the opposed picture element electrodes;

wherein the potential of said common electrode is changed so as to satisfy at least one of the following two conditions thereby to compensate for a parasitic capacitance given by the switching transistor;

decreasing the potential of said common electrode during a display cycle of the lower potential level of said two potential levels, and increasing the potential of said common electrode during a display cycle at the higher potential level.

2. The liquid-crystal panel driving method according to claim 1 wherein changing the potential of said common electrode during a display cycle at the lower voltage level is accomplished by one of linearly and non-linearly decreasing said potential and changing the potential of said common electrode during a display cycle at the higher voltage level is accomplished by one of linearly and non-linearly increasing said potential.

3. The liquid-crystal panel driving method according to claim 2 wherein the increase and the decrease in potential of said common electrodes are continuous.

4. The liquid-crystal panel driving method according to claim 2 wherein the increase and the decrease in potential of said common electrode are stepwise.

5. The liquid-crystal panel driving method according to claim 1 wherein the lower and the higher voltages are different in polarity.

6. The liquid-crystal panel driving method according to claim 1 wherein said switching transistor comprises a thin film transistor forming a parasitic capacitance between the gate and the drain thereof.

7. In a method for driving a display panel of the type in which each of display picture elements arranged in a matrix is provided with a switching transistor having a gate connected to a scanning line, a source connected to a data line and a drain, and a capacitor having one end connected to said drain of said switching transistor and the other end connected to a common electrode; the driving method comprising:

switching the potential of said common electrode between two levels at each display cycle thereby to apply an alternating electric field of two voltage levels to the respective picture elements in association with the potential level of the opposed picture element electrodes;

the improvement wherein the potential of said common electrode is changed so as to satisfy at least one of the following two conditions thereby to compensate for a parasitic capacitance given by the switching transistor;

decreasing the potential of said common electrode during a display cycle at the lower potential level of said two potential levels; and increasing the potential of said common electrode during a display cycle at the higher potential level.

8. The display panel driving method according to claim 7 wherein changing the potential of said common electrode during a display cycle at the lower voltage level is accomplished by one of linearly and non-linearly decreasing said potential and changing the potential of said common electrode during a display cycle at the higher voltage level is acomplished by one of linearly and non-linearly increasing said potential.

9. The display panel driving method according to claim 8 wherein the increase and decrease in potential of said common electrode are continuous.

10. The display panel driving method according to claim 8 wherein the increase and decrease in potential of said common electrode are stepwise.

11. The display panel driving method according to claim 7 wherein the lower and higher voltages are different in polarity.

12. The display panel driving method according to claim 7 wherein said switching transistor comprises a thin film transistor forming a parasitic capacitance between the gate and the drain thereof.

* * * * *

UNITED STATES PATENT AND TRADEMARK OFFICE

CERTIFICATE OF CORRECTION

PATENT NO. : 4,675,667

DATED : June 23, 1987

INVENTOR(S) : TAKASHI NAKAMURA, ET AL.

It is certified that error appears in the above-identified patent and that said Letters Patent is hereby corrected as shown below:

COLUMN 2

Line 16, "decreases" should read --decreased--.
Line 32, "$\Delta V_{EFC} \approx \Delta V$" should read --$\Delta V_{EFC} \approx \Delta V$--.
Line 45, "leftside" should read --left side--.

COLUMN 4

Line 4, "OF PREFERRED" should read --OF THE PREFERRED--.
Line 25, "$A\vee$" should read --$\Delta\vee$--.
Line 55, "potential the" should read --potential of the--.

COLUMN 5

Line 49, "S, gate" should read --S), gate--.

COLUMN 6

Line 38, "electrodes" should read --electrode--.
Line 51, "matrix is" should read --matrix array is--.

COLUMN 7

Line 12, "acomplished" should read --accomplished--.

Signed and Sealed this

Twenty-fourth Day of November, 1987

*Attest:*

DONALD J. QUIGG

*Attesting Officer*

*Commissioner of Patents and Trademarks*